US005255588A

United States Patent [19]

Foos et al.

[11] Patent Number: 5,255,588

[45] Date of Patent: Oct. 26, 1993

[54] APPARATUS FOR MAKING ACCURATE CUTS IN THERMOFORMED ARTICLES

[75] Inventors: Douglas E. Foos, Barrington Hills; Todd O. Buck, Carol Stream, both of Ill.

[73] Assignee: Plastofilm Industries, Inc., Wheaton, Ill.

[21] Appl. No.: 892,151

[22] Filed: Jun. 2, 1992

[51] Int. Cl.[5] ..... B26F 1/02

[52] U.S. Cl. ..... 83/879; 83/449; 83/660; 83/700; 83/914

[58] Field of Search ..... 83/438, 449, 914, 440, 83/440.1, 444, 879, 883, 660, 640, 620, 697, 700; 493/354, 363; 72/330, 331, 338

[56] References Cited

U.S. PATENT DOCUMENTS

| | | | |
|---|---|---|---|
| 1,543,010 | 6/1925 | Johnson | 83/440 |
| 2,171,262 | 8/1939 | Beekman et al. | 83/914 X |
| 3,461,756 | 8/1969 | Mojonnier | 83/914 X |
| 4,175,460 | 11/1979 | McPhail | 83/440 X |
| 4,358,979 | 11/1982 | Kurzbuch | 83/660 X |
| 4,581,008 | 4/1986 | Reil | 493/363 |
| 4,700,481 | 10/1987 | Barret | 83/700 X |

*Primary Examiner*—Frank T. Yost
*Assistant Examiner*—Kenneth E. Peterson
*Attorney, Agent, or Firm*—Welsh & Katz, Ltd.

[57] ABSTRACT

An apparatus for making accurate cuts in thermoformed articles projecting vertically above a generally planar sheet of thermoformable material includes a base plate having a lower surface, at least one pair of knives being mounted to the lower surface of the base plate to depend therefrom and being capable of limited movement, each knife having a cutting portion and a guiding portion, the guiding portion of each knife being angled relative to the longitudinal axis of each knife and being divergent from the adjacent knife. Each pair of knives is disposed on the base plate, and the base plate is disposed relative to the sheet of thermoformable material so that thermoformed articles advanced toward the apparatus will engage the guiding portions of the knives and cause the knives to slidingly contact sides of the articles, and upon lowering the base plate toward the sheet, the cutting portions of the knives are positioned to create score lines in the sheet which are substantially flush with the sides of the articles.

14 Claims, 2 Drawing Sheets

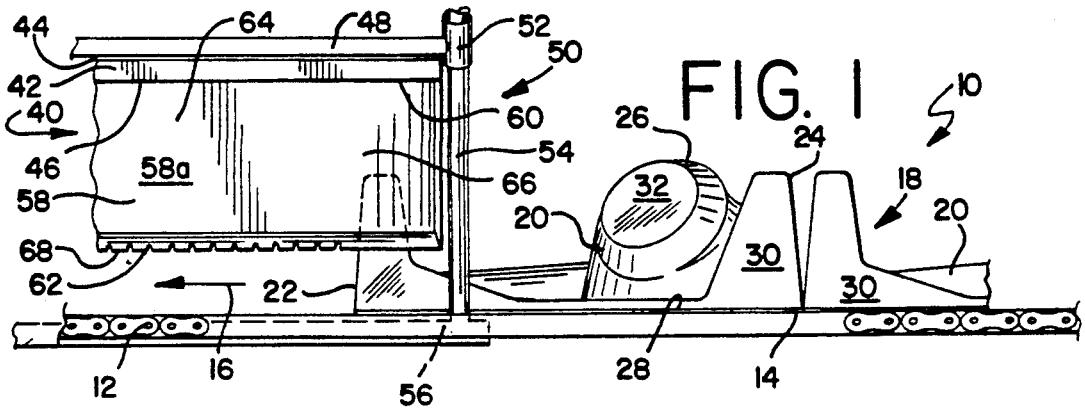
FIG. 1
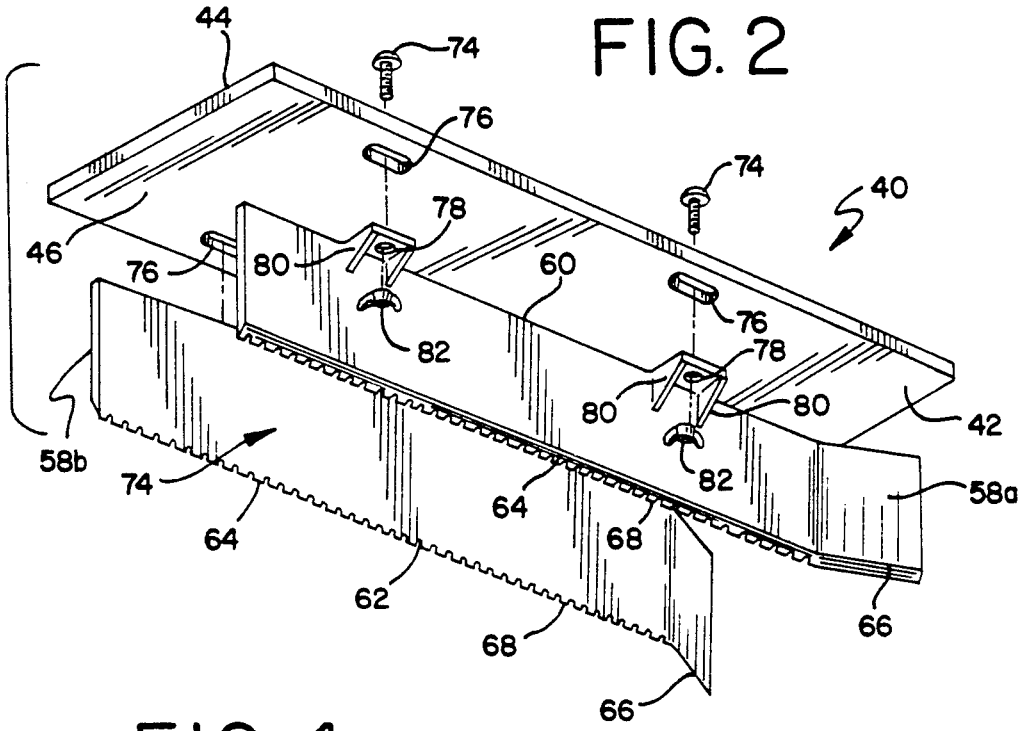
FIG. 2
FIG. 4
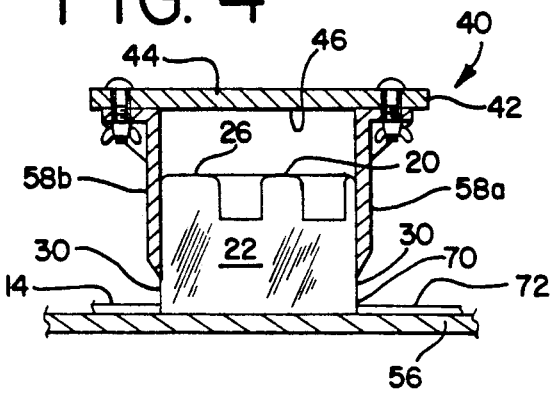

APPARATUS FOR MAKING ACCURATE CUTS IN THERMOFORMED ARTICLES

BACKGROUND OF THE INVENTION

The present invention relates to machines used for die cutting thermoformed articles from sheets of thermoformable source material, and specifically to a cutting apparatus for making incisions such as cuts or score lines which are in alignment with vertical sides of the thermoformed articles.

In a typical thermoforming operation, a sheet of plastic thermoformable material is drawn in a web from a roll to a first station where it is heated, and then to a thermoforming die station including a set of thermoforming dies. In the operation, the sheet is moved from one station to another by a conveyor system including a pair of generally parallel chain belts, as are known in the art.

The die set includes the male member, which has a plurality of vertically projecting formations and shapes consisting of the desired final configuration of the thermoformed article, and the female member, which is basically a "negative" of the male member. The male and female dies are moveable in a vertically reciprocable fashion with the plastic sheet sandwiched between the two dies. As the dies come together, the heated plastic softens and forms around the vertically projecting formations and shapes of the male die. The female die assists the formation of the plastic about the male die. In some cases, the male die is equipped with a vacuum assist and the female die with a pressure assist to more effectively draw and shape the plastic about the formations of the male die.

After forming, the male and female dies separate, leaving the sheet with at least one thermoformed article. The number of articles formed is determined by the number of cavities in the die set. After the forming process, the conveyor system is designed to index the sheet as it cools. This indexing moves the recently formed articles a specified distance away from the die set, and makes room at the die set for the next thermoforming cycle, during which a second portion of the sheet of plastic material is shaped by the dies. Through indexing, the use of the material is maximized.

After two or three indexes or thermoforming cycles, the first set of molded articles reaches a knife or die cutting press station, where specially designed knives mounted to depend from an underside of a press block are pressed downward upon the sheet. This downward pressing action cuts the articles from the sheet. In some cases, instead of cutting the articles, the knives are configured to merely score the plastic around the articles, to create hinged seams.

A common problem of such thermoforming operations is that the indexing is imprecise, and the knives improperly cut or even damage the thermoformed articles, creating wasted material. One attempted solution to this problem has been the mounting of the knife to the support block so that the knives are movable in a direction parallel to the direction of travel of the articles on the thermoforming apparatus. These so-called "floating" knives accommodate a certain amount of error in the indexing process, and are normally accurate to ± 0.030 inches. However, in some thermoformed articles, this degree of error is unsatisfactorily high.

Another measure commonly taken to avoid misalignment of the thermoformed articles relative to the knives is to shape the articles to have a drafted forward surface which guides the knives to the proper cutting position. These measures are satisfactory for most thermoformed articles, but not for those articles used in packages where the longitudinal edges of the article are not cut by the die press, but instead are merely scored to form hinged flaps. Upon scoring, these hinged flaps are folded backward to support products carried behind the thermoformed article when the article and products are eventually enclosed in a container or box.

In such packages, the score lines need to be located in substantially flush relationship with the corresponding sidewall of the thermoformed article. Conventional floating knives have proved incapable of accurately and reliably making the required score lines in the thermoformed articles.

Consequently, it is an object of the present invention to provide an apparatus for making accurate cuts in thermoformed articles.

It is another object of the present invention to provide an apparatus for accurately cutting thermoformed articles which accommodates misalignment of the thermoformed articles due to inaccurate indexing.

It is still another object of the present invention to provide an apparatus for accurately cutting thermoformed articles which is capable of reliably making score lines in the articles which are substantially flush with the corresponding sidewall of the article.

SUMMARY OF THE INVENTION

Accordingly, the above-identified objects are met or exceeded by the present invention, which provides a floating knife type die cutting apparatus for cutting or scoring thermoformed articles. The present apparatus includes at least one pair of generally parallel knife blades which are configured to guide the thermoformed articles for accurate cutting. Furthermore, the knife blades are preferably maintained in a ready position which is at a height between the upper edge of the thermoformed article and the upper surface of the sheet from which the articles are formed.

More specifically, the present invention provides an apparatus for making accurate cuts in at least one thermoformed article projecting vertically above a generally planar sheet from which the at least one article is formed. The apparatus includes a base plate having a lower surface, at least one pair of knives being mounted to the lower surface of the base plate to depend therefrom, each knife having a cutting portion and a guiding portion. Each pair of knives is disposed on the base plate so that thermoformed articles advanced with the sheet toward the cutting apparatus will engage the guiding portions of the knives and cause the knives to slidingly contact sidewalls of the articles. Upon lowering the base plate toward the sheet, the cutting portions of the knives are positioned to create incisions in the sheet which are substantially flush with the sidewalls of the articles.

BRIEF DESCRIPTION OF THE DRAWINGS

FIG. 1 is a side elevational view of a sheet of thermoformed articles being advanced toward the apparatus of the invention for scoring or cutting;

FIG. 2 is an exploded perspective elevational view of the apparatus of the invention;

FIG. 4 is a vertical sectional view taken along the line 4—4 of FIG. 3C and in the direction indicated generally.

DETAILED DESCRIPTION OF THE PREFERRED EMBODIMENT

Figure 3A:
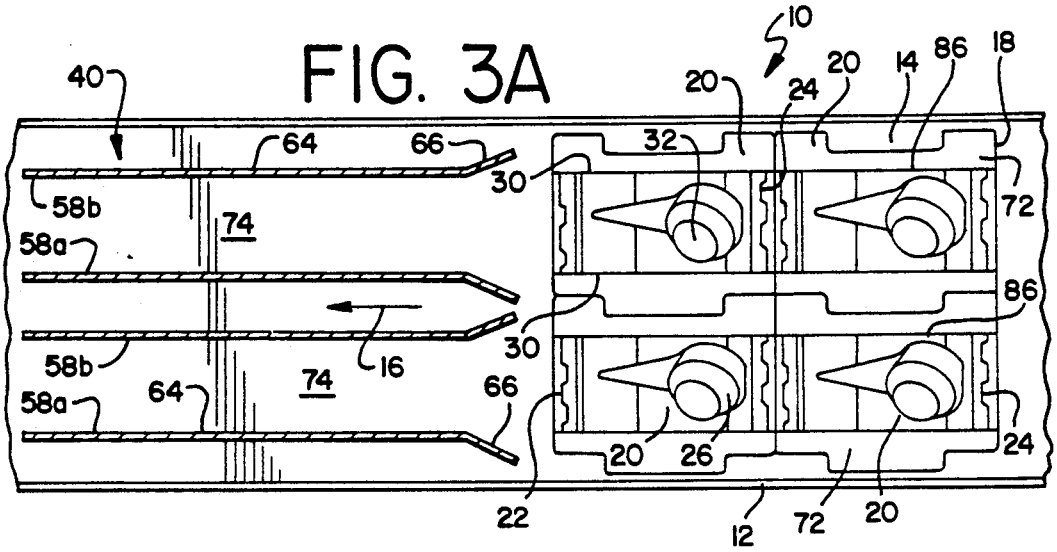
FIG. 3A is a diagrammatic plan view of a sheet of thermoformed articles being advanced toward the apparatus of the invention.

Referring now to the drawings, FIG. 1 illustrates a portion of a thermoforming operation, generally designated 10, which includes a conveyor 12, such as a pair of endless chain belts, to which a generally planar sheet 14 of plastic material is advanced in a direction represented by the arrow 16. At the cyclical stage of the thermoforming process depicted in FIG. 1, a portion 18 of the sheet 14 has just been advanced past a pair of forming dies (not shown) which are located to the right of the portion of the operation 10 depicted in FIG. 1. The dies are used to create at least one thermoformed article 20 from the sheet 14, so that the article projects vertically from the sheet. In FIG. 1, two such articles 20 are depicted, however the number of thermoformed articles created by a die set at each cycle depends on the number of cavities in the die set, as is well known to skilled practitioners.

Each thermoformed article 20 includes a front end 22, a rear end 24, a top 26, a bottom 28, and a pair of sidewalls 30. The front end 22 and the rear end 24 are preferably drafted to assist the separation of the articles from the dies and also to facilitate the separation of nested articles from each other. In the preferred embodiment, the thermoformed article 20 is a portion of a point-of-purchase package, and a part 32 of the article is configured to take the shape of a portion of the product to be packaged.

The cutting apparatus of the invention is generally designated 40, and includes a base plate 42 having an upper surface 44 and a lower surface 46. The base plate 42 is secured to an upper platen 48 of a conventional die cutting press generally designated 50. The upper platen 48 is generally a horizontally disposed flat plate provided with preferably four vertically positioned sleeves 52 (only one illustrated), one located at each corner, which each slidably engage a vertical member 54. The vertical members 54 are each secured at a lower end to a lower platen 56 across which the sheet 14 is drawn by the conveyor chain 12. The upper platen 48 is powered such as by conventionally known pneumatic or hydraulic power systems (not shown) so that knives 58 attached to the upper platen impact the lower platen 56 on a cyclical basis.

Referring now to FIGS. 1 and 2, at least one pair of knives 58, designated 58*a* and 58*b* are preferably disposed in spaced, parallel relation to each other and are mounted to the lower surface 46 of the base plate 42 to depend therefrom. In the preferred embodiment, each knife 58 is generally bar-shaped and has an upper edge 60, a lower edge 62, and is functionally partitioned into a cutting portion 64 and a guiding portion 66.

The cutting portion 64 of each knife 58 is defined by the sharpened lower edge 62, which may be provided with serrations 68 as in FIGS. 1 and 2. The serrations 68 are employed in applications when a perforated incision such as a score line 70 (best seen in FIG. 4) is to be formed to create a hinged flap 72 from a portion of the surrounding sheet 14. Alternately, a straight, sharpened lower edge 62 may be used to completely separate the article 20 from the surrounding sheet 14 at the point of impact of the blade.

In the preferred embodiment, the cutting portion 64 of each knife 58 is generally parallel to the cutting portion of the adjacent knife of the pair of knives, and the cutting portions of each pair of knives defines a cutting zone 74 which is configured to accommodate at least one thermoformed article 20 therein. The cutting portion 64 preferably extends at least as long as two articles 20 placed end-to-end.

The guiding portion 66 of each knife 58 is located upstream of the cutting portion 64 so that the thermoformed articles 20 engage the guiding portion prior to engaging the cutting portion. In addition, the guiding portion 66 is angled relative to the longitudinal axis of each knife 58, and is divergent from the adjacent knife of the pair of knives. Thus, the guiding portion 66 of knife 58*a* diverges from the knife 58*b*, and vice versa. The amount of angular divergence of the guiding portion 66 depends on the application and upon the configuration of the thermoformed article 20.

The positioning of each knife 58*a*, 58*b* of the pair of knives 58 on the base plate 42 is designed so that thermoformed articles 20 advanced with the sheet 14 toward the cutting apparatus 40 will engage the guiding portions 66 and cause inner surfaces of the cutting portions 64 of the knives to slidingly contact the sidewalls 30 of the articles. Thus, in the preferred embodiment, the knives 58*a*, 58*b* are spaced apart only slightly wider than the width of the thermoformed article 20.

The knives 58 are secured to the base plate 42 by a plurality of fasteners 74, such as bolts, which pass through linearly elongated openings 76 in the base plate. In the preferred embodiment, four such openings 76 are provided, however the number of openings may vary with the application. To engage the fasteners 74, the upper edge 60 of each knife 58 is provided with at least one eyelet 78 projecting transversely to the longitudinal axis of the knife, and each eyelet is disposed to be in register with a corresponding opening 76. The eyelets 78 are preferably supported by a gusset 80 on each side.

A threaded wingnut 82 or equivalent fastener is provided to engage each of the fasteners 74 to secure the knife 58 to the base plate 42. When the wingnuts 82 are tightened upon the fasteners 74, the elongate shape of the openings 76 allows the knife 58 to move slightly or "float" relative to the base plate 42 along the longitudinal axis of the knife.

An important feature of the invention is that during normal operation, the base plate 42 is adjusted on the die press 50 to be vertically movable between an upper position (best seen in FIG. 1) wherein the lower edges 62 of the knives 58 are disposed at a height which is less than or equal to the height of the thermoformed article 20, and a lower position wherein the lower edges of the knives are in contact with the sheet 14. In some cases, the distance between the upper position and the lower position may be only 0.5 inch (1.25 cm). The upper position of the base plate 42 in the present invention is significantly lower than the uppermost position of the base plate in conventional thermoforming operations using the type of floating knives previously known in the art.

The base plate 42 is moved from the upper position to the lower position under force to cause a desired cutting or scoring action in the sheet 14. Sufficient force may be generated by the die cutting press 50 to achieve adequate cuts or score lines even though there is a relatively short distance between the upper position and the lower position of the base plate 42.

Referring now to FIG. 3A, the apparatus 40 of the invention is diagrammatically depicted in plan view, and is shown including two pair of knives 58, the knives of each pair being labeled 58*a* and 58*b*. It is evident that the pairs of knives are generally parallel to each other, with the diverging guiding portions 66 of each pair of knives 58 defining a generally "Y"-shaped configuration as seen from above. Furthermore, it is evident that the guiding portions 66 of adjacent knives 58*a*, 58*b* of adjacent pairs of knives converge toward each other.

In FIG. 3A, a sheet 14 of thermoformable material is seen advancing in the direction indicated by the arrow 16 toward the present cutting apparatus 40. There are four thermoformed articles 20 which have been formed by the thermoforming die set. The articles 20 are arranged upon the portion 18 of sheet 14 to maximize space. In the preferred embodiment, each thermoformed article 20 includes a pair of the laterally extending flaps 72 which are substantially coplanar with the sheet 14. In the final boxes into which the articles 20 are each inserted upon assembly, the flaps 72 fold backward to be coplanar with the side walls 30 and to protect portions of the packaged product.

Due to the nature of the final use of the thermoformed article 20 depicted in FIGS. 1, 3A-3C and 4, it is especially desirable that the article be manufactured so that the flaps 72 fold backward along a seam 86 which is substantially flush with the sidewalls 30. The cutting apparatus 40 of the invention is specifically designed to achieve this goal.

Figure 3B:
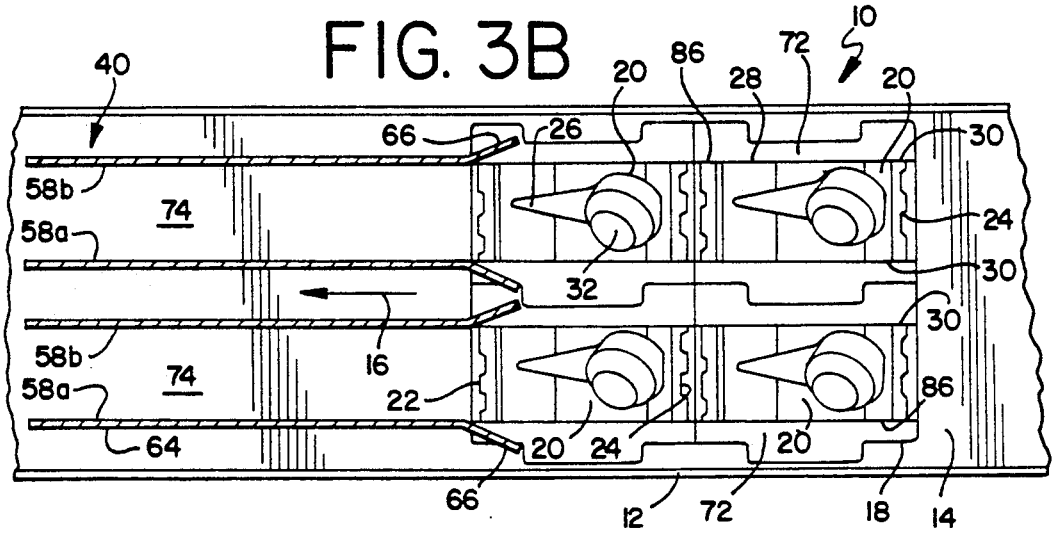
FIG. 3B is a diagrammatic plan view of a sheet of thermoformed articles being engaged by the guiding portion of the apparatus of the invention.

Referring now to FIG. 3B, the group of thermoformed articles 20 on the portion 18 has been indexed through one cycle, which has brought the front ends 22 of the articles into engagement with the guiding portions 66 of the knives 58. It will be seen here that the guiding portions 66 are configured to direct the articles 20 to a specified position directly between the knives 58*a* and 58*b* of each pair of knives, in order to compensate for any misalignment in the indexing or conveying mechanisms. Such misalignment is often due to uneven stretching of the conveyor chains 12, or of the sheet 14 of plastic itself. The feature of the diverging shape of the guiding portions 66 is assisted by the relatively lower upper operating position of the base plate 42, which enables the knives 58 to guide the articles into position.

FIG. 4 illustrates the close tolerances between the adjacent knives 58*a*, 58*b* and the thermoformed articles 20 which are achieved through the cutting apparatus 40 of the invention. In this manner, the score lines 70 which are created by the cutting portions 64 of the knives are substantially flush with the sidewalls 30 of the articles 20. In some applications, the cutting apparatus 40 of the invention may provide cuts with a range of $\pm 0''$ variability.

Figure 3C:
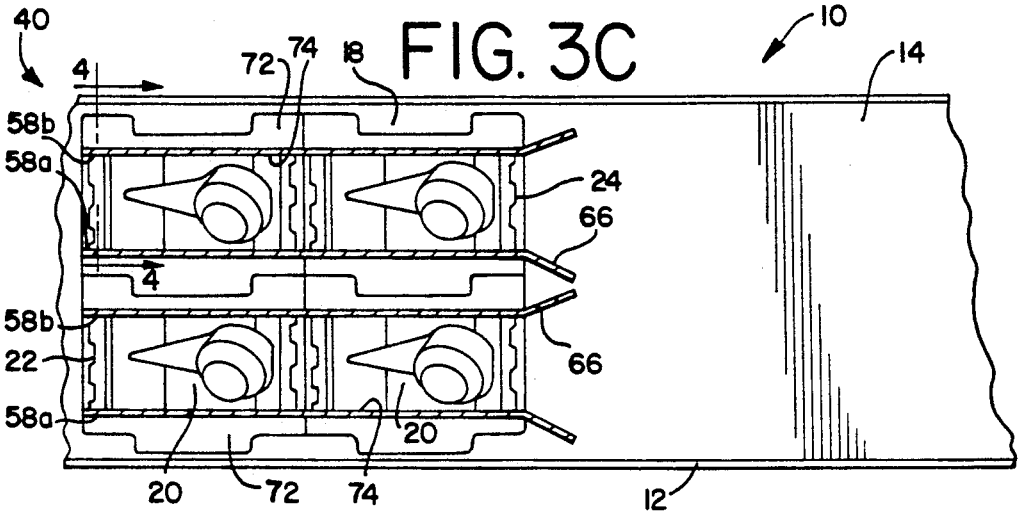
FIG. 3C is a diagrammatic plan view of the sheet of thermoformed articles of FIG. 3B shown in a position for scoring by the apparatus of the invention.

Referring now to FIG. 3C, the sheet 14 is shown having been indexed another cycle in the direction 16, so that all four of the articles 20 in the portion 18 which were formed in one thermoforming cycle are directly between adjacent knives 58*a*, 58*b*. In order to fully accommodate groups of articles 20 of varying lengths, the knives 58 are preferably longer than any group of articles designed to be used with that particular set of knives.

Upon the triggering of an automatic impact cycle by the pneumatic power system, the base plate 42 descends toward the sheet 14. The cutting portions 64 of the knives 58 create score lines 70 in the sheet which are substantially flush with the sidewalls 30 of the articles 20. A subsequent indexing cycle will bring the group of articles 20 to another die cutter (not shown), which will separate each article 20 from the sheet 14.

Thus, the present cutting apparatus 40, including its floating knives 58 each having a cutting portion with a separate diverging guiding portion, and having a relatively lowered upper operational position, is capable of accurately making cuts or score lines in thermoformed articles without damaging the articles. In this way the creation of thermoformed products is accomplished in less time with less waste.

While a particular embodiment of the apparatus for making accurate cuts in thermoformed articles of the invention has been shown and described, it will be appreciated by those skilled in the art that changes and modifications may be made thereto without departing from the invention in its broader aspects and as set forth in the following claims.

What is claimed is:

1. An apparatus for making accurate cuts in at least one thermoformed article projecting vertically above a generally planar sheet from which said at least one article is formed, said apparatus comprising:

a base plate having a lower surface;

at least one pair of knives being mounted to said lower surface of said base plate to depend therefrom;

each said knife having a generally planar guiding portion and a generally planar portion having a cutting edge;

means for lowering said knives in a first direction;

means for moving said sheet in a second direction;

wherein said portions of said knives having a cutting edge are parallel to said first direction and said second direction, and said guiding portion of said knives are parallel to the first direction and obliquely angled to the second direction; and each said pair of knives being disposed on said base plate so that thermoformed articles advanced with the sheet toward said apparatus will engage said guiding portions of said knives and cause said knives to slidingly contact sides of said articles, and upon lowering said base plate toward the sheet, said cutting portions of said knives being positioned to create incisions in the sheet which are substantially flush with the sides of the articles.

2. The apparatus as defined in claim 1 wherein each said knife has a longitudinal axis, and said guiding portion of each said knife is angled relative to the longitudinal axis of each said knife.

3. The apparatus as defined in claim 2 wherein said guiding portion of each said knife is divergent from said adjacent knife of said at least one pair.

4. The apparatus as defined in claim 1 wherein each said knife also has an upper edge surface for engaging said lower surface of said base plate, and a sharpened lower edge surface for making cuts in or around the thermoformed article.

5. The apparatus as defined in claim 1 wherein the knives are mounted to the base plate to be permitted at least limited movement relative to said base plate.

6. The apparatus as defined in claim 1 wherein said cutting portions of said at least one pair of knives are disposed in spaced, parallel relation to each other.

7. The apparatus as defined in claim 1 wherein said apparatus has an upstream end and a downstream end, said cutting portion is disposed in a downstream direction relative to said guiding portion so that the thermoformed articles engage said guiding portion prior to engaging said cutting portion.

8. The apparatus as defined in claim 1 wherein said means for lowering said knives includes a die press which is adjusted so that said base plate is vertically movable from an upper operational position wherein said lower edges of said at least one pair of knives are disposed at a height which is less than or equal to the height of the thermoformed article, and a lower position wherein said lower edges of said at least one pair of knives are in contact with the sheet.

9. The apparatus as defined in claim 1 further including two pairs of knives, said pairs of knives being disposed in spaced parallel relation to each other so that said guiding portions of adjacent knives of said adjacent pairs are angled to converge towards each other.

10. The apparatus as defined in claim 1 wherein a portion of said lower edge of each of said knives is serrated to create a perforated score line in the sheet.

11. The apparatus as defined in claim 1 wherein said base plate is releasably secured to a die block of a press.

12. The apparatus as defined in claim 1 wherein said means for lowering said knives includes a die press, said base plate being adjusted on said die press so that said lower edge of each of said knives is maintained at an upper position above the sheet so that said guiding portion of the knife is less than or equal to the height of the thermoformed article.

13. An apparatus for making accurate cuts in at least one thermoformed article projecting vertically above a generally planar sheet from which said at least one article is formed, said apparatus comprising:

a base plate having a lower surface;

at least one pair of knives being mounted to said lower surface of said base plate to depend therefrom, and to be slidable to at least a limited extent relative to said base plate;

each said knife having a generally planar guiding portion and a generally planar portion having a cutting edge, said guiding portion being angled relative to said cutting portion;

means for lowering said knives in a first direction;

means for moving said sheet in a second direction;

wherein said portions of said knives having a cutting edge are parallel to said first direction and said second direction, and said guiding portion of said knives are parallel to the first direction and obliquely angled to the second direction; and each said pair of knives being disposed on said base plate so that thermoformed articles advanced with the sheet toward said apparatus will engage said guiding portions of said knives and cause said knives to slidingly contact sides of said articles, and upon lowering said base plate toward the sheet, said cutting portions of said knives being positioned to create incisions in the sheet which are substantially flush with the sides of the articles.

14. A thermoformed article trimming apparatus for use in a thermoforming device including means for lowering said apparatus in a first direction, and means for moving a sheet of vertically projecting thermoformed article in a second direction, said article trimming apparatus comprising:

a base plate having a lower surface;

at least one pair of knives being mounted to said lower surface of said base plate to depend therefrom;

each said knife having a generally planar guiding portion and a generally planar portion having a cutting edge;

wherein said portions of said knives having a cutting edge are parallel to the first direction and the second direction, and said guiding portion of said knives are parallel to the first direction and obliquely angled to the second direction; and each said pair of knives being disposed on said base plate so that thermoformed articles advanced with the sheet toward said apparatus will engage said guiding portions of said knives and cause said knives to slidingly contact sides of said articles, and upon lowering said base plate toward the sheet, said cutting portions of said knives being positioned to create incisions in the sheet which are substantially flush with the sides of the articles.

* * * * *